US005964613A

United States Patent [19]

Huang

[11] Patent Number: 5,964,613

[45] Date of Patent: Oct. 12, 1999

[54] GARDEN LAMP POLE DEVICE

[76] Inventor: Shun-Feng Huang, No.56, Min Sheng Street, Feng-Yuan City 42041, Taiwan

[21] Appl. No.: 09/085,324

[22] Filed: May 26, 1998

[51] Int. Cl.[6] ..... H01R 4/24

[52] U.S. Cl. ..... 439/417; 439/419; 439/658

[58] Field of Search ..... 439/417, 419, 439/425, 402, 658, 659

[56] References Cited

U.S. PATENT DOCUMENTS 5,888,090 2/1997 Achee ..... 439/417

*Primary Examiner*—Steven L. Stephan
*Assistant Examiner*—Javaid Nasri

[57] ABSTRACT

A garden lamp pole device has an insertion tang, a hollow protection casing disposed on the insertion tang, and a branch wire set positioned by the hollow protection casing. The branch wire set has a first electric wire, a second electric wire, and a hard string. A clamp seat positions the branch wire set and a connection wire set. The connection wire set is connected to a socket seat. The clamp seat has a main seat, an auxiliary seat, a first conductive plate, and a second conductive plate. The clamp seat clamps the branch wire set and a connection wire set. A socket seat and a cover plate clamps the connection wire set.

1 Claim, 12 Drawing Sheets

GARDEN LAMP POLE DEVICE

BACKGROUND OF THE INVENTION

This invention relates to a garden lamp pole device, and more particularly, this invention relates to a lamp pole device which can be used as a candelabrum.

Referring to FIG. 1, a conventional garden lamp pole device has an insertion tang 1 inserted in the ground, a plug 3 connected to an electric source wire 2, three branch wire sets 4 connected to the electric source wire 2, each branch wire set 4 connected to a lamp holder 5, and each lamp holder 5 receiving a bulb 6. Each branch wire set 4 has two wires. However, the branch wire sets 4 cannot be shaped stably while bending. Therefore, the branch wire set 4 should be clustered in a small region.

SUMMARY OF THE INVENTION

An object of this invention is to provide a garden lamp pole device which has a plurality of branch wire sets to be shaped stably while bending.

Another object of this invention is to provide a garden lamp pole device which has a plurality of clamp seats to position more branch wire sets and more bulbs.

DETAILED DESCRIPTION OF THE INVENTION

Figure 1:
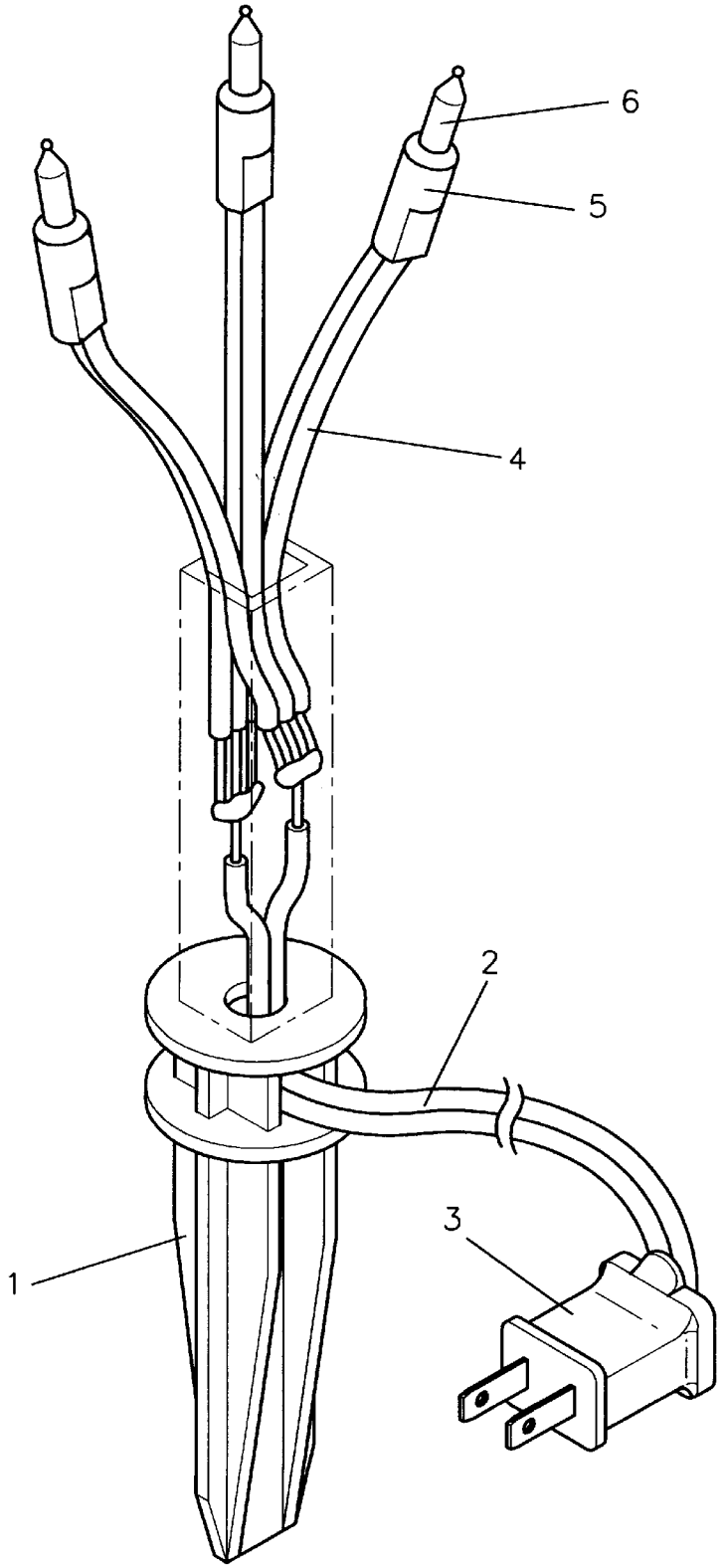
FIG. 1 (Prior Art)
FIG. 1 is a perspective view of a conventional garden lamp pole device of the prior art.
Figure 2:
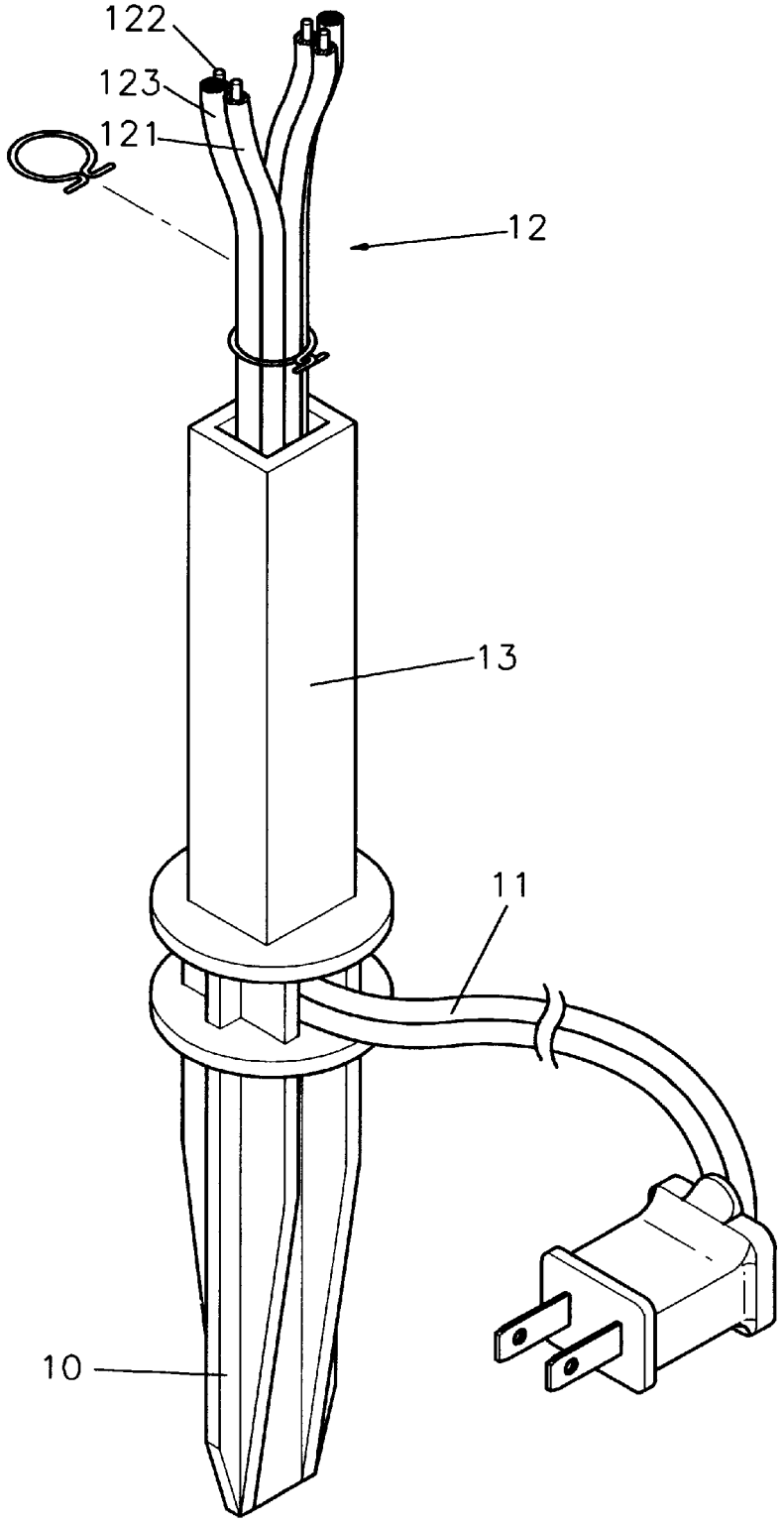
FIG. 2 is a perspective view of a garden lamp pole device of a preferred embodiment in accordance with this invention.
Figure 3:
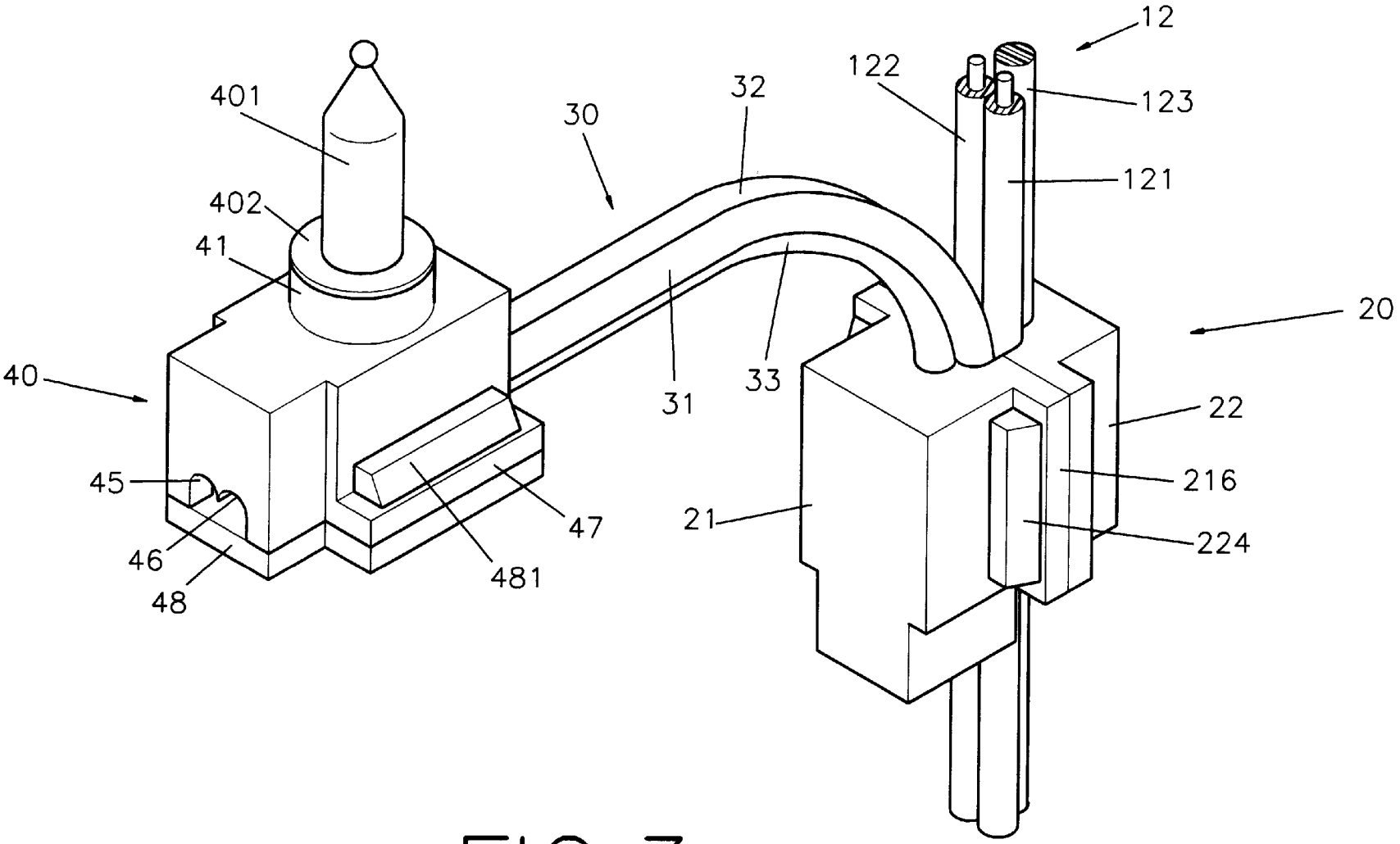
FIG. 3 is a perspective view of a clamp seat, a branch wire set, a socket seat, and a connection wire set of a preferred embodiment in accordance with this invention.
Figure 4:
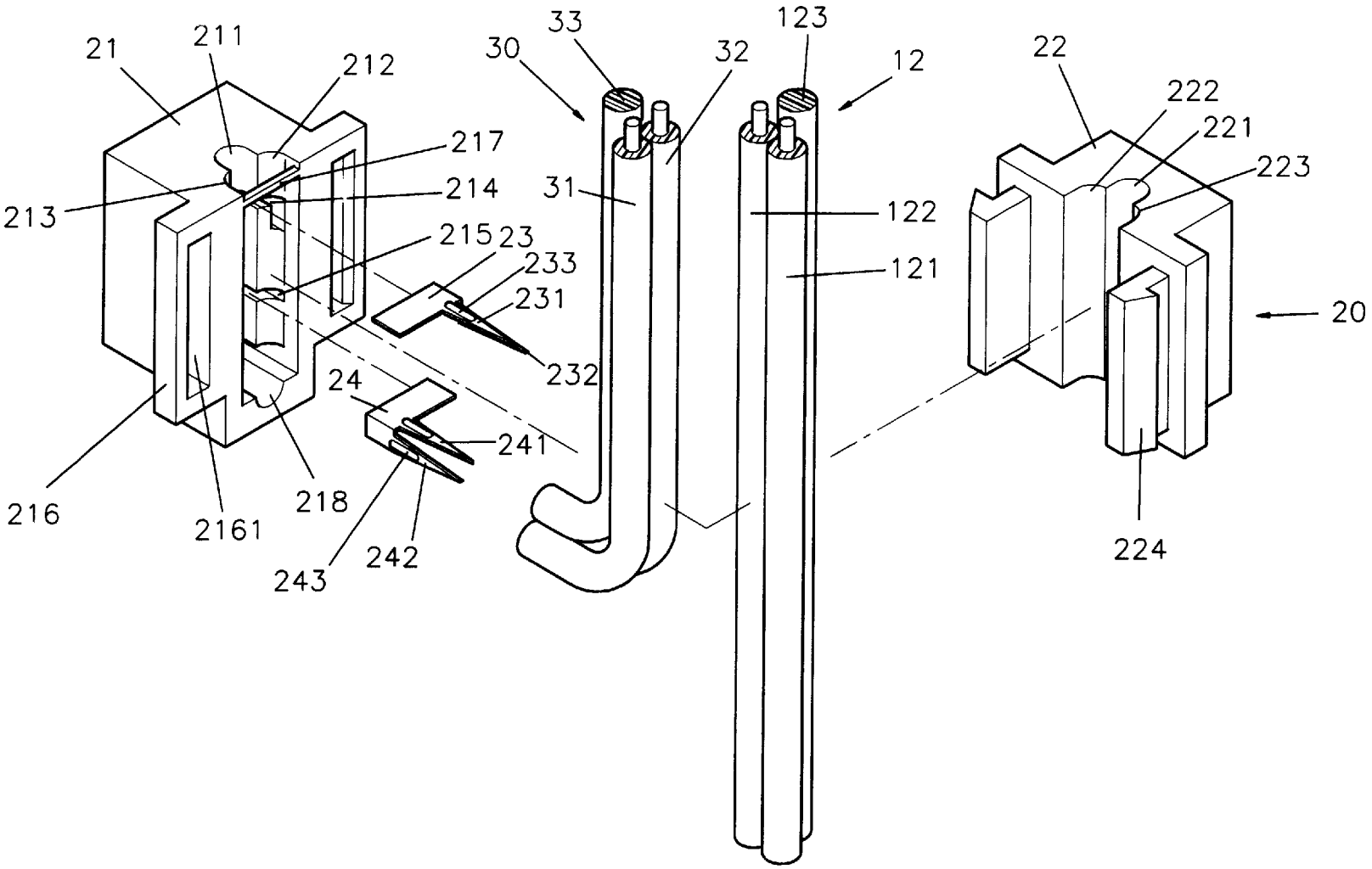
FIG. 4 is a perspective exploded view of a clamp seat of a preferred embodiment in accordance with this invention.
Figure 6:
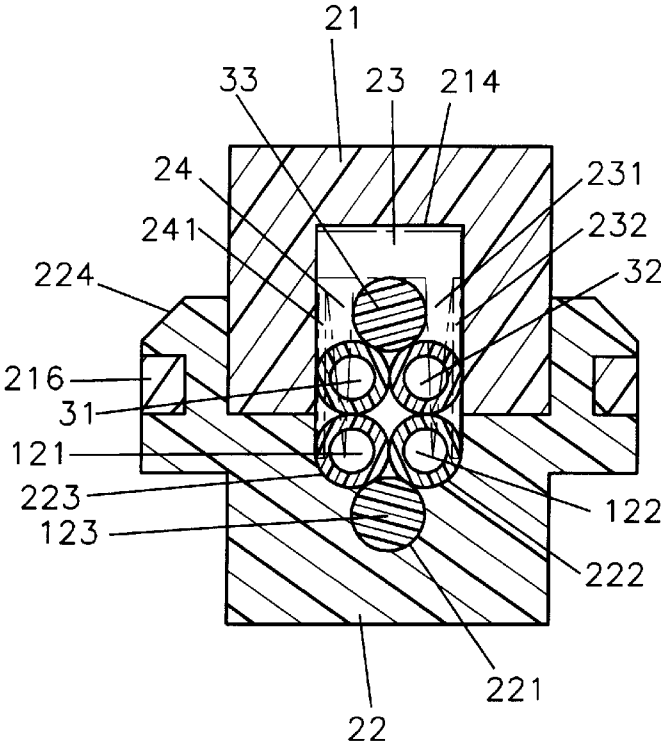
FIG. 6 is another sectional view of a clamp seat, a branch wire set, and a connection wire set of a preferred embodiment in accordance with this invention.
Figure 5:
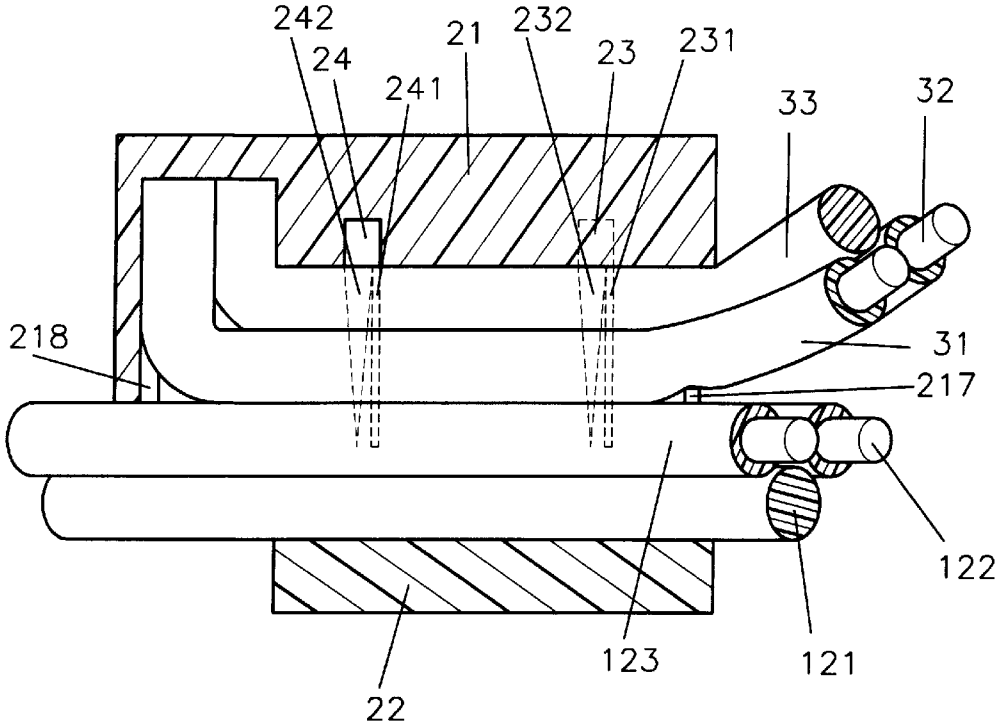
FIG. 5 is a sectional view of a clamp seat, a branch wire set, and a connection wire set of a preferred embodiment in accordance with this invention.
Figure 7:
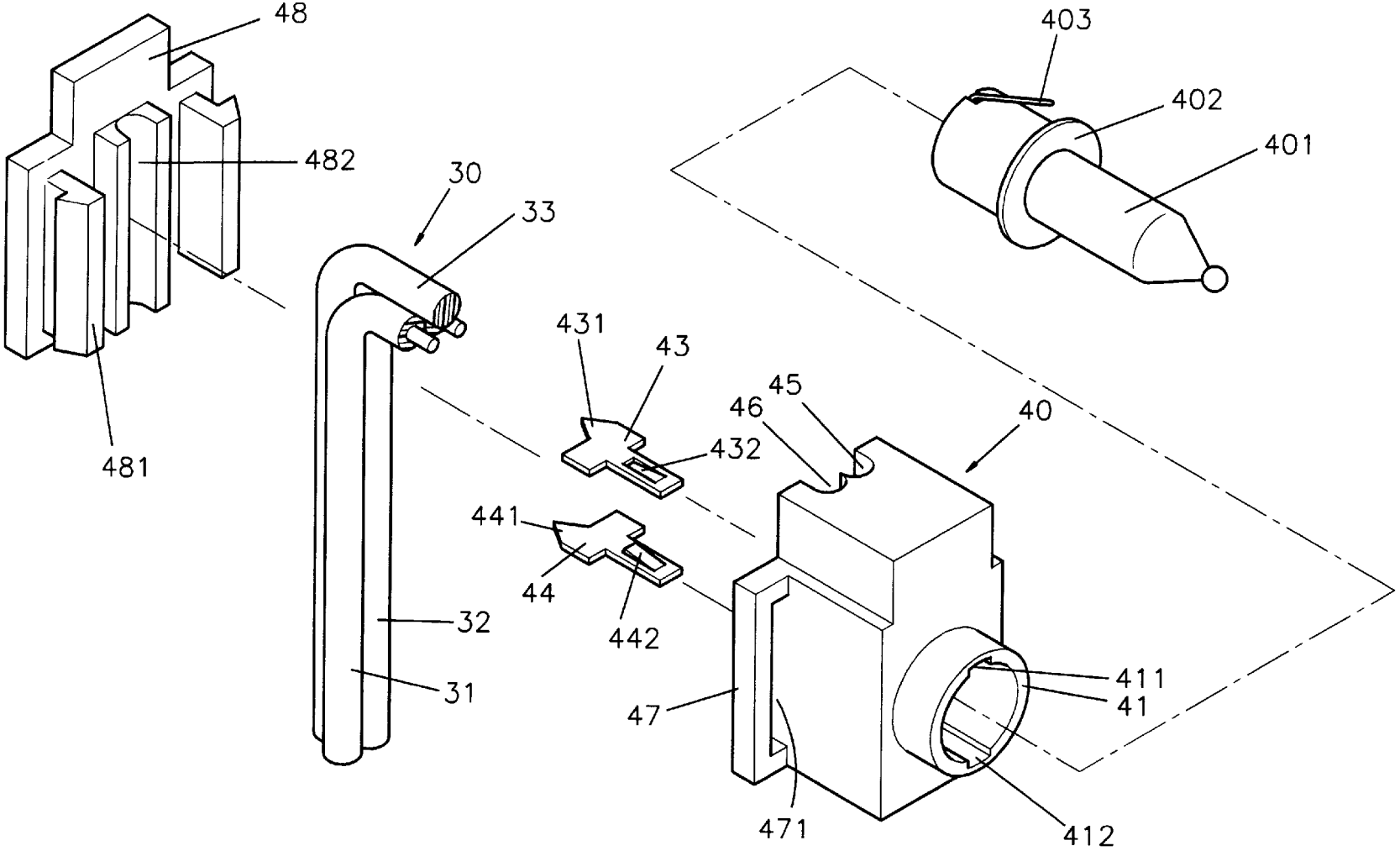
FIG. 7 is a perspective exploded view of a socket seat of a preferred embodiment in accordance with this invention.
Figure 9:
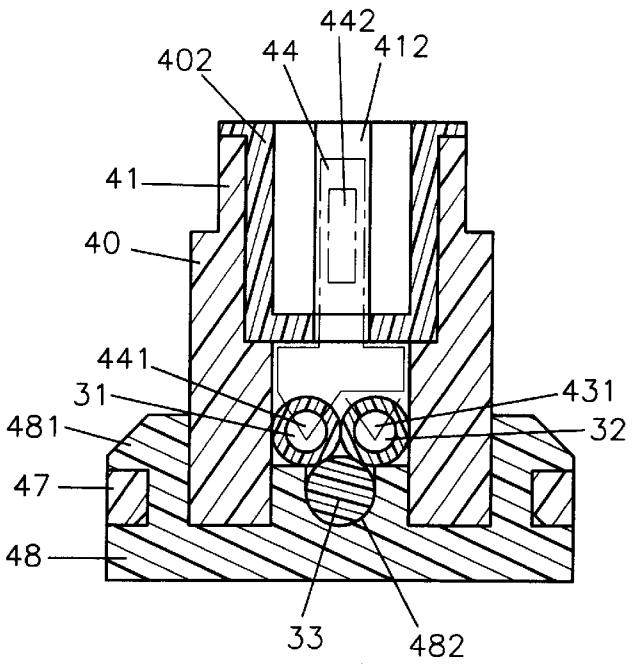
FIG. 9 is another sectional view of a socket seat and a connection wire set of a preferred embodiment in accordance with this invention.

Referring to FIGS. 2 to 9, a garden lamp pole device comprises an insertion tang 10, a hollow protection casing 13 disposed on the insertion tang 10, an electric source wire 11 passing through the hollow protection casing 13, a plurality of branch wire sets 12 connected to the electric source wire 11, and the branch wire sets 12 positioned by the hollow protection casing 13. Each branch wire set 12 has a first electric wire 121, a second electric wire 122, and a hard string 123. The hard string 123 can be bent and shaped. The hard string 123 is made of metals. A clamp seat 20 positions one of the branch wire sets 12 and a connection wire set 30. The connection wire set 30 is connected to a socket seat 40. The clamp seat 20 comprises a main seat 21, an auxiliary seat 22, a first conductive plate 23, and a second conductive plate 24. The connection wire set 30 has a first auxiliary wire 31, a second auxiliary wire 32, and a support string 33. The main seat 21 has a first linear groove 211, a second linear groove 212, a third linear groove 213, an upper recess 214, a lower recess 215, a lower groove 218, a separation bar 217, and two protruded plates 216. Each of the protruded plates 216 has a positioning hole 2161. The upper recess 214 receives the first conductive plate 23. The lower recess 215 receives the second conductive plate 24. The first conductive plate 23 has a first protruded tip 231 and a second protruded tip 232. The second conductive plate 24 has a third protruded tip 241 and a fourth protruded tip 242. The auxiliary seat 22 has a first linear recess 221, a second linear recess 222, a third linear recess 223, and two hook-shaped plates 224. The connection wire set 30 passes through the main seat 21. The first linear groove 211 receives the support string 33. The second linear groove 212 receives the second auxiliary wire 32. The third linear groove 213 receives the first auxiliary wire 31. One of the branch wire sets 12 passes through the auxiliary seat 22. The first linear recess 221 receives the hard string 123. The second linear recess 222 receives the second electric wire 122. The third linear recess 223 receives the first electric wire 121. Each of the hook-shaped plates 224 is inserted in the respective positioning hole 2161. The first protruded tip 231 and the second protruded tip 232 penetrate the second auxiliary wire 32 and the second electric wire 122. The third protruded tip 241 and the fourth protruded tip 242 penetrate the first auxiliary wire 31 and the first electric wire 121.

Figure 8:
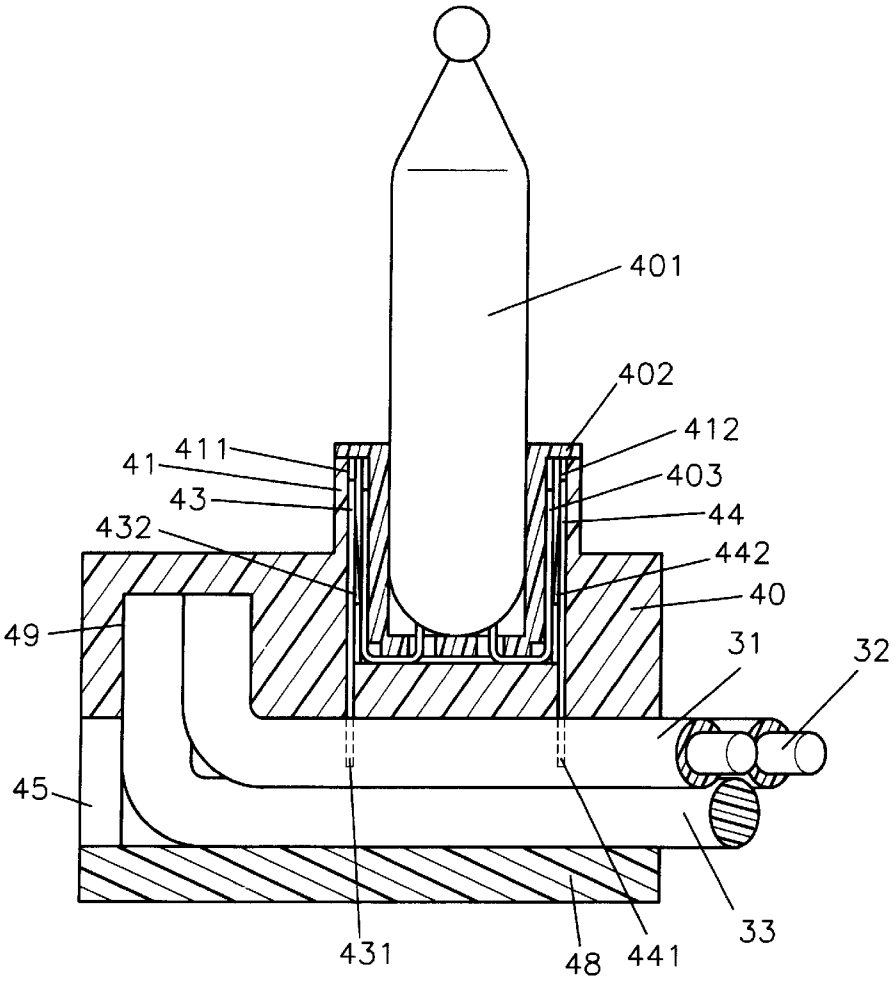
FIG. 8 is a sectional view of a socket seat and a connection wire set of a preferred embodiment in accordance with this invention.

A socket seat 40 has a collar 41 having a first inner recess 411 and a second inner recess 412, a first linear channel 45, a second linear channel 46, and two lug plates 47. The first inner recess 411 receives a third conductive plate 43. The second inner recess 412 receives a fourth conductive plate 44. Each of the lug plates 47 has a through hole 471. The first linear channel 45 receives the second auxiliary wire 32. The second linear channel 46 receives the first auxiliary wire 31. A cover plate 48 covers the socket seat 40. The cover plate 48 has an extended groove 482 and two hook-shaped lobes 481. The extended groove 482 receives the support string 33. Each of the hook-shaped lobes 481 is inserted in the respective through hole 471. The collar 41 receives a lamp holder 402. The lamp holder 402 receives a bulb 401. Two filaments 403 extend from an interior of the bulb 401 to an exterior of the lamp holder 402. The third conductive plate 43 has a first end tip 431 and a first elastic plate 432. The fourth conductive plate 44 has a second end tip 441 and a second elastic plate 442. The first end tip 431 penetrates the second auxiliary wire 32. The second end tip 441 penetrates the first auxiliary wire 31. Referring to FIG. 8, the cover plate 48 has a slot 49 receiving the connection wire set 30.

Figure 10:
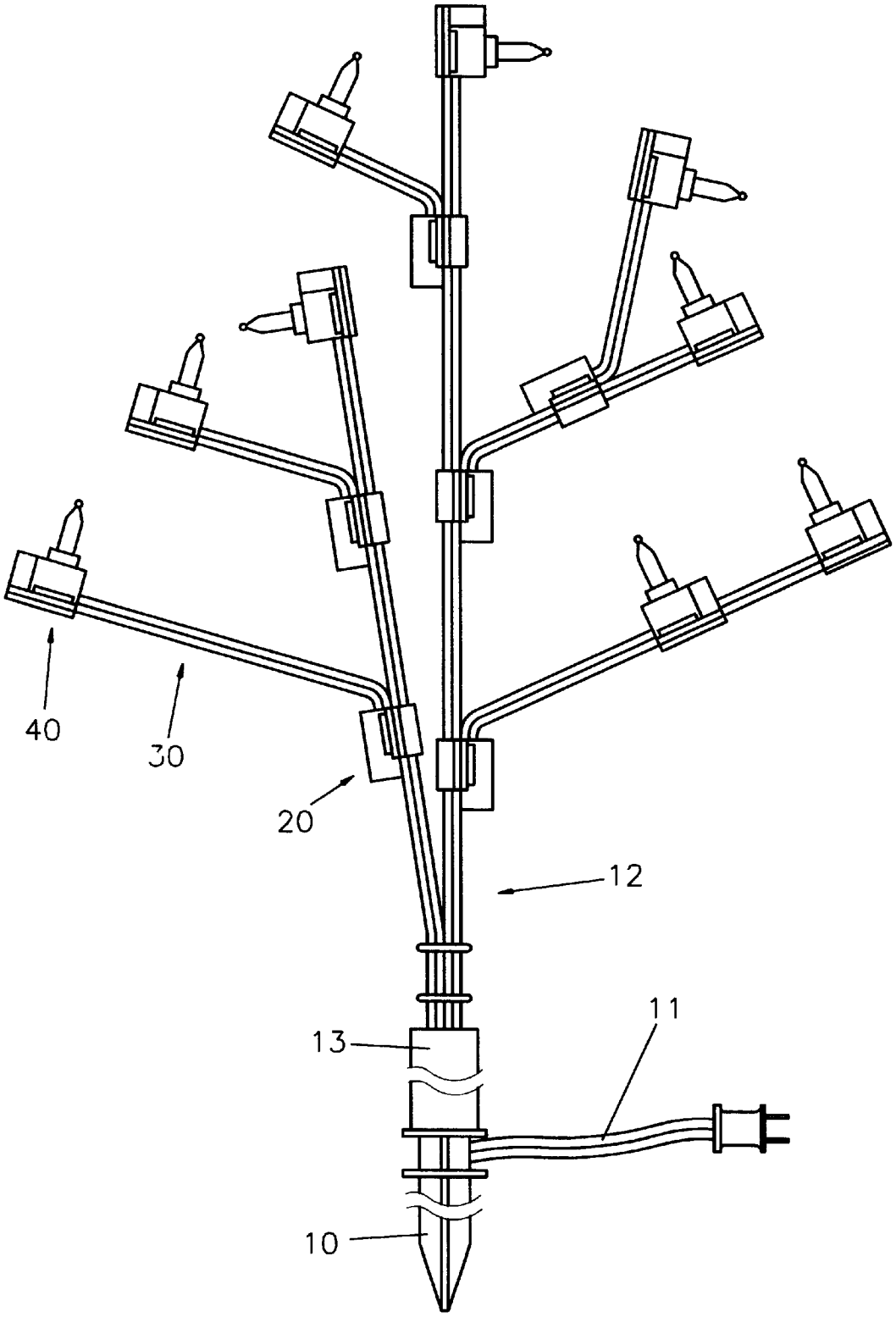
FIG. 10 is a schematic view of a garden lamp assembly of a preferred embodiment in accordance with this invention.

Referring to FIG. 10, the garden lamp pole device has five clamp seats 20 and a large number of socket seats 40. A large number of bulb 401 are disposed on the garden lamp pole device.

Figure 13:
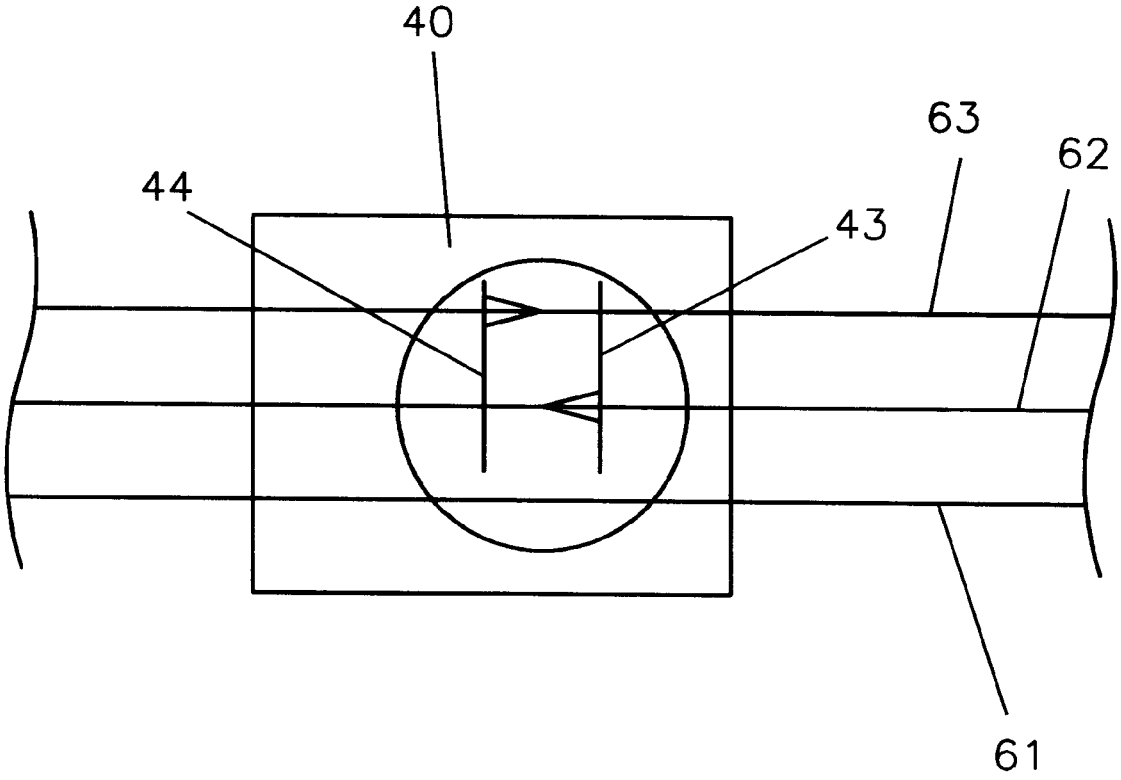
FIG. 13 is a schematic view illustrating a hard string positioned by a socket seat.
Figure 13A:
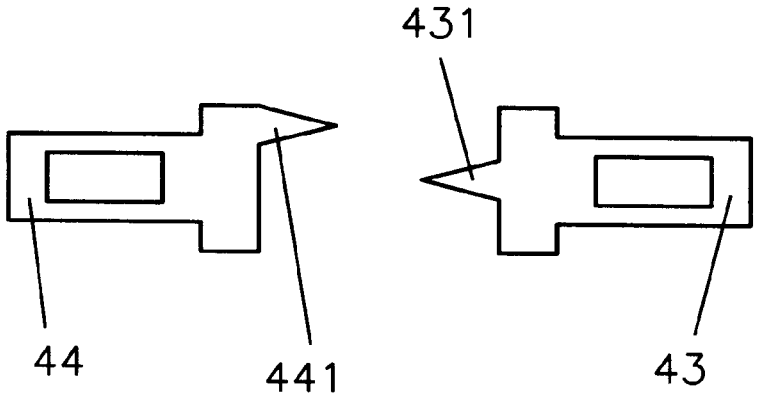
FIG. 13A is a schematic view of a third conductive plate and a fourth conductive plate.

Referring to FIGS. 13 and 13A, the first end tip 431 and the second end tip 441 face each other. A first metal string 61 supports a first wire 62 and a second wire 63. The first end tip 431 penetrates the first wire 62. The second end tip 441 penetrates the second wire 63.

Figure 14:
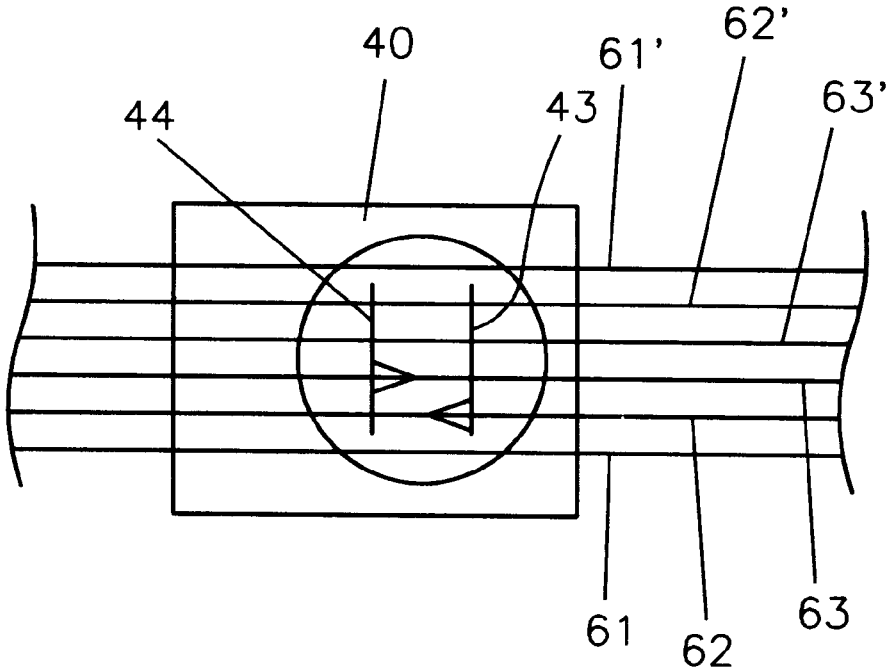
FIG. 14 is a schematic view illustrating a plurality of hard strings can be disposed in parallel.
Figure 14A:
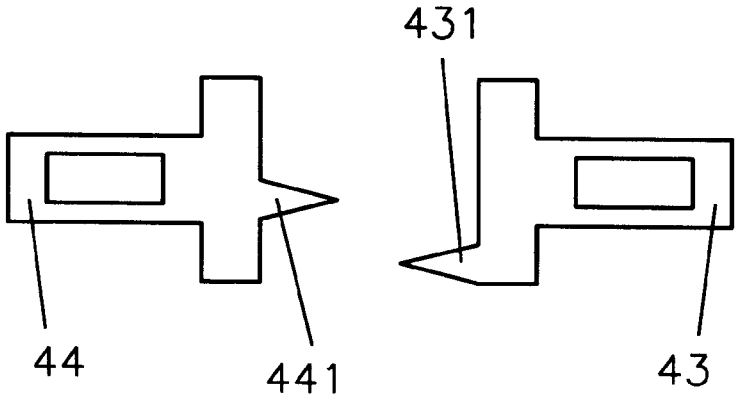
FIG. 14A is another schematic view of a third conductive plate and a fourth conductive plate.

Referring to FIGS. 14 and 14A, the first end tip 431 and the second end tip 441 face each other. A first metal string 61 supports a first wire 62 and a second wire 63. The first end tip 431 penetrates the first wire 62. The second end tip 441 penetrates the second wire 63. A second metal string 61' supports a third wire 62' and a fourth wire 63'. The first metal string 61 and the second metal string 61' are in parallel. The first wire 62 and the third wire 62' are in parallel. The second wire 63 and the fourth wire 63' are in parallel.

Figure 11:
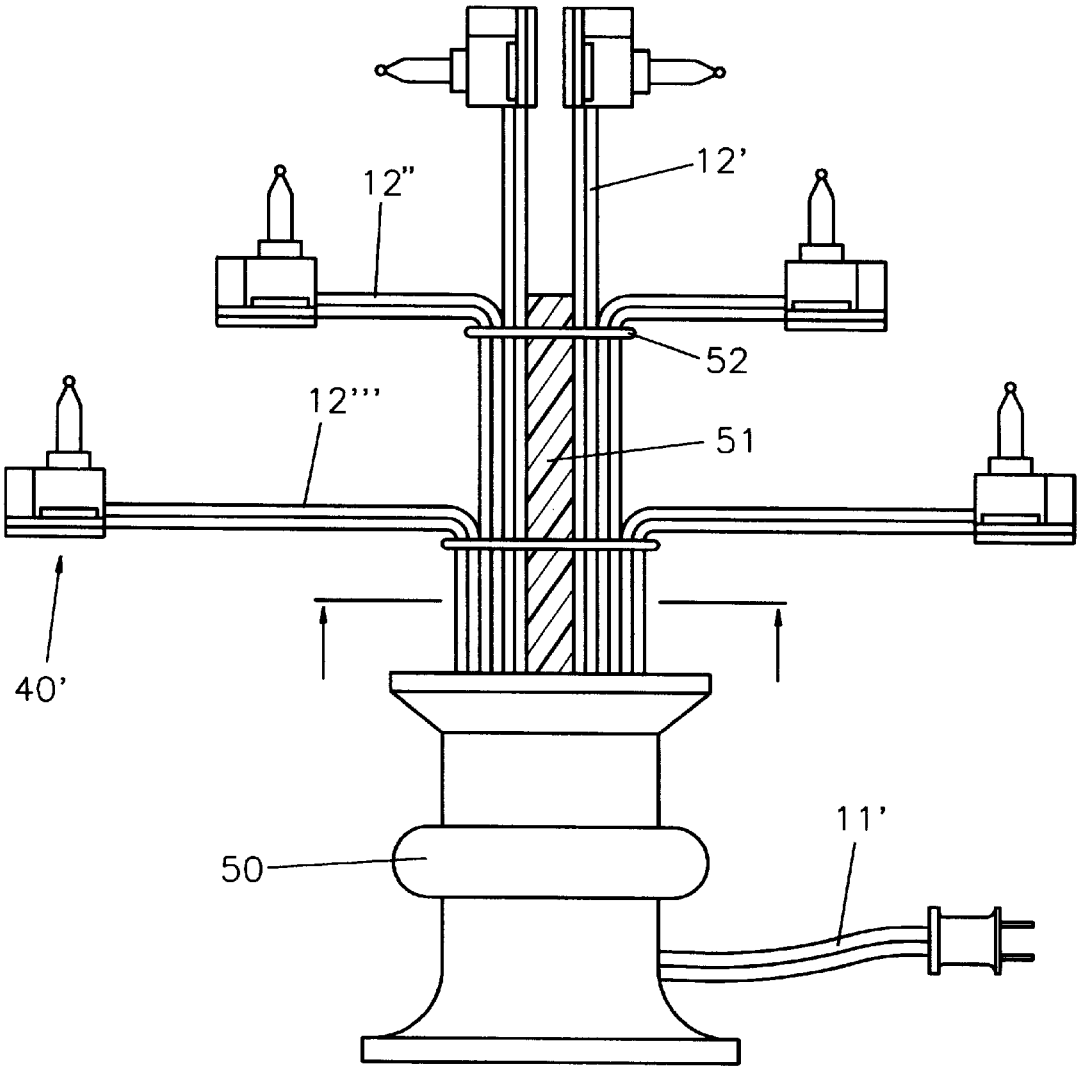
FIG. 11 is a schematic view of a candelabrum of a preferred embodiment in accordance with this invention.
Figure 12:
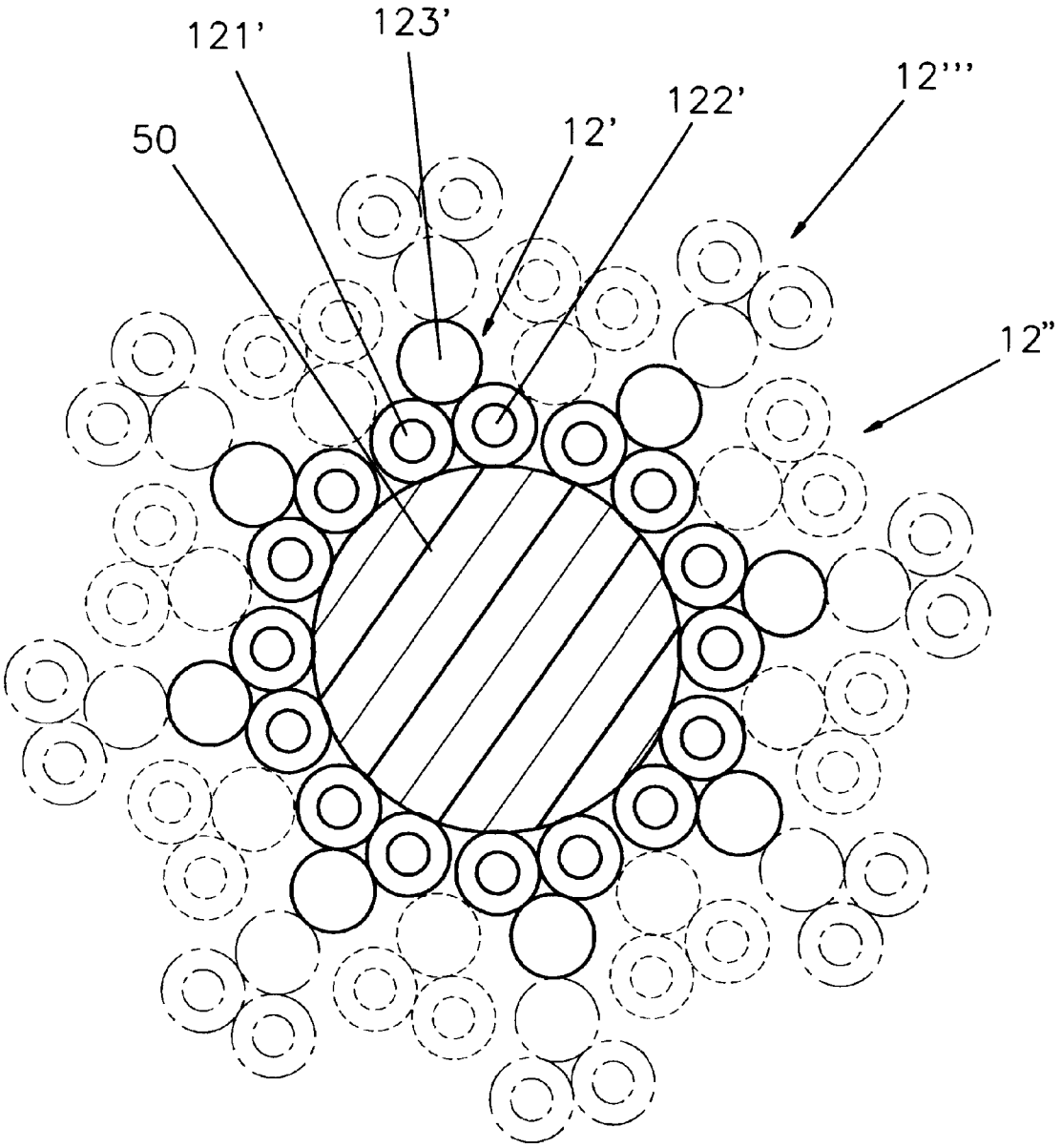
FIG. 12 is a cross-sectional view of FIG. 11.

Referring to FIGS. 11 and 12, a candelabrum has a candelstand 50, a post 51, an electric source wire 11' connected to the candelstand 50, and a plurality of branch wire sets 12', 12", and 12"'. Each of the branch wire sets 12', 12", and 12"' is connected to a socket seats 40'. The branch wire sets 12' has a first electric wire 121', a second electric wire 122', and a hard string 123'.

I claim:

1. A garden lamp pole device comprises:

an insertion tang, a hollow protection casing disposed on the insertion tang, an electric source wire passing through the hollow protection casing, at least a branch wire set connected to the electric source wire, and the branch wire set positioned by the hollow protection casing, the branch wire set having a first electric wire, a second electric wire, and a hard string, a clamp seat positioning the branch wire set and a connection wire set, the connection wire set connected to a socket seat, the clamp seat comprising a main seat, an auxiliary seat, a first conductive plate, and a second conductive plate, the connection wire set having a first auxiliary wire, a second auxiliary wire, and a support string, the main seat having a first linear groove, a second linear groove, a third linear groove, an upper recess, a lower recess, a lower groove, a separation bar, and two protruded plates, each of the protruded plates having a positioning hole, the upper recess receiving the first conductive plate, the lower recess receiving the second conductive plate, the first conductive plate having a first protruded tip and a second protruded tip, the second conductive plate having a third protruded tip and a fourth protruded tip, the auxiliary seat having a first linear recess, a second linear recess, a third linear recess, and two hook-shaped plates, the connection wire set passing through the main seat, the first linear groove receiving the support string, the second linear groove receiving the second auxiliary wire, the third linear groove receiving the first auxiliary wire, the branch wire set passing through the auxiliary seat, the first linear recess receiving the hard string, the second linear recess receiving the second electric wire, the third linear recess receiving the first electric wire, each of the hook-shaped plates inserted in the respective positioning hole, the first protruded tip and the second protruded tip penetrating the second auxiliary wire and the second electric wire, the third protruded tip and the fourth protruded tip penetrating the first auxiliary wire and the first electric wire, a socket seat having a collar having a first inner recess and a second inner recess, a first linear channel, a second linear channel, and two lug plates, the first inner recess receiving a third conductive plate, the second inner recess receiving a fourth conductive plate, each of the lug plates having a through hole, the first linear channel receiving the second auxiliary wire, the second linear channel receiving the first auxiliary wire, a cover plate covering the socket seat, the cover plate having an extended groove and two hook-shaped lobes, the extended groove receiving the support string, each of the hook-shaped lobes inserted in the respective through hole, the third conductive plate having a first end tip and a first elastic plate, the fourth conductive plate having a second end tip and a second elastic plate, the first end tip penetrating the second auxiliary wire, and the second end tip penetrating the first auxiliary wire.

* * * * *